US007976593B2

(12) United States Patent
Graham

(10) Patent No.: US 7,976,593 B2
(45) Date of Patent: Jul. 12, 2011

(54) GASIFIER AND GASIFIER SYSTEM FOR PYROLIZING ORGANIC MATERIALS

(75) Inventor: Robert G. Graham, Presque Isle, MI (US)

(73) Assignee: Heat Transfer International, LLC, Kentwood, MI (US)

( * ) Notice: Subject to any disclaimer, the term of this patent is extended or adjusted under 35 U.S.C. 154(b) by 212 days.

(21) Appl. No.: 12/215,147

(22) Filed: Jun. 25, 2008

(65) Prior Publication Data

US 2009/0000195 A1 Jan. 1, 2009

Related U.S. Application Data

(60) Provisional application No. 60/937,309, filed on Jun. 27, 2007.

(51) Int. Cl.
*B01J 7/00* (2006.01)

(52) U.S. Cl. ..... 48/61; 48/76; 48/77; 48/74; 48/89; 48/107; 110/275; 110/276; 110/105; 110/108; 110/110; 110/157; 110/160; 110/165 R; 110/165 A; 110/175 R; 110/181

(58) Field of Classification Search ..... 48/76, 77, 48/74, 11; 110/275–276, 105, 108, 110, 110/157, 160, 165 R, 165 A, 175 R, 181
See application file for complete search history.

(56) References Cited

U.S. PATENT DOCUMENTS

| | | | | | |
|---|---|---|---|---|---|
| 2,933,057 | A | * | 4/1960 | Wilson | 110/259 |
| 3,377,266 | A | * | 4/1968 | Salnikov | 208/402 |
| 3,758,317 | A | * | 9/1973 | Moore | 501/95.1 |
| 3,974,021 | A | * | 8/1976 | Bernadiner et al. | 159/4.02 |
| 4,177,742 | A | * | 12/1979 | Uemura et al. | 110/346 |
| 4,184,436 | A | | 1/1980 | Palm et al. | |
| 4,312,278 | A | | 1/1982 | Smith et al. | |
| 4,321,877 | A | | 3/1982 | Schmidt et al. | |
| 4,430,948 | A | | 2/1984 | Schafer et al. | |
| 4,593,629 | A | | 6/1986 | Pedersen et al. | |
| 4,691,846 | A | | 9/1987 | Cordell et al. | |
| 4,779,544 | A | * | 10/1988 | Stevens | 110/110 |
| 4,785,744 | A | * | 11/1988 | Fontaine | 110/214 |
| 4,971,599 | A | | 11/1990 | Cordell | |
| 5,106,390 | A | * | 4/1992 | Beierle et al. | 48/197 R |
| 5,138,957 | A | | 8/1992 | Morey et al. | |
| 5,284,103 | A | * | 2/1994 | Hand et al. | 110/255 |
| 6,485,296 | B1 | * | 11/2002 | Bender et al. | 432/58 |
| 6,786,943 | B1 | * | 9/2004 | Jaccard et al. | 48/197 FM |
| 6,817,185 | B2 | * | 11/2004 | Coney et al. | 60/772 |
| 2004/0069192 | A1 | * | 4/2004 | McCaffrey et al. | 110/336 |

FOREIGN PATENT DOCUMENTS

JP 60147007 * 8/1985

* cited by examiner

*Primary Examiner* — Kaity V. Handal
(74) *Attorney, Agent, or Firm* — Robert L. McKellar; McKellar IP Law, PLLC

(57) ABSTRACT

A gasifier and gasifier system based on the gasifier, which contains as a major component, a novel feed system for feeding organic materials into the burn pile of the gasifier. The gasifier feed system is a horizontal auger driven feed system that feeds directly through a ceramic elbow into the furnace without having to auger the feed through significant vertical elevations.

8 Claims, 4 Drawing Sheets

GASIFIER AND GASIFIER SYSTEM FOR PYROLIZING ORGANIC MATERIALS

This application claims priority from U.S. Provisional Patent application ser. no. 60/937,309, filed Jun. 27, 2007.

The invention disclosed and claimed herein is a gasifier and gasifier system based on the gasifier, which contains as a major component, a novel feed system for feeding organic materials into the burn pile of the gasifier.

The invention is useful for gasifying solid organic materials and using such gasified products for conversion to thermal energy.

Materials that can be gasified using this invention include, among other materials, biomass materials, such as forestry and agricultural residues, industrial waste materials, such as saw mill pulp and paper products, hydrocarbon based products and plastics, and the like.

BACKGROUND OF THE INVENTION

It has been known in the art for a long time to use industrial and agricultural solid organic by-products, such as forestry an agricultural residue and the like, as potential sources of large amount of chemical energy. Such organic materials are frequently referred to as "biomass" materials. There is a large library of patents and other publications dealing with gasifiers (retorts) and associated systems for creating energy from biomass materials.

Patents dealing with such systems are for example, U.S. Pat. No. 4,971,599 that issued to Cordell on Nov. 20, 1990; U.S. Pat. No. 4,691,846 that issued to Cordell, et al. on Sep. 8, 1987; U.S. Pat. No. 4,593,629 that issued to Pedersen, et al. on Jun. 10, 1986; U.S. Pat. No. 4,430,948 that issued to Schafer, et al. on Feb. 14, 1984; U.S. Pat. No. 4,321,877 that issued to Schmidt, et al. on Mar. 30, 1982; U.S. Pat. No. 4,312,278 that issued to Smith, et al. on Jan. 26, 1982; U.S. Pat. No. 4,184,436 that issued to Palm, et al. on Jan. 22, 1980, and U.S. Pat. No. 5,138,957 that issued to Morey, et al. on Aug. 18, 1992.

However, none of these patents deal with a horizontal auger system to deliver feed material to a discharge elbow that discharges directly to a burn pile in the gasifier. The prior art deals with vertical auger units and most of them deal with a double vertical auger system. The disadvantage to the use of vertical augers is that the inside vertical auger cannot be repaired while the system is on-line, and they have a tendency to burn up at the tip when dry fuels are fired, or when there is an upset in the system. This problem has been completely eliminated by the use of a single, horizontal auger firing into a ceramic discharge elbow for discharging directly into the burn pile.

The gasifier of the instant invention is less costly to build and operate, easier to maintain, has fewer moving parts and contains nearly 100% ceramic internals to prevent warping and contortion of metal parts that are used in the prior art devices.

SUMMARY OF THE INVENTION

In accordance with the present invention, there is provided a low cost to build, low cost to operate, easier to maintain, and relatively simple gasifier and system. The gasifier is used in a gasification system to provide recovery of energy from feed stock of forestry and agricultural residues, such as industrial waste materials such a pulp and paper products, hydrocarbon based products, such as plastic and the like, by gasification of such materials with the inventive gasifier and employment of the inventive system disclosed herein.

THE INVENTION

Thus, in more detail, there is an improved gasifier system for pyrolizing organic material, the gasifier system comprising a gasifier having a cylindrical housing. The cylindrical housing has a steel sidewall and the sidewall is completely lined with a refractory material. The sidewall has a top and a bottom.

The top of the sidewall is closed and sealed with a monolithic dome, the dome comprising a steel-walled hemi-elliptical section. The hemi-elliptical section comprises a height to diameter ratio of at least 1 to 2 and the dome has a top and is completely lined with a refractory material. The dome has a syngas exit duct centered at the top and the bottom of the sidewall is fixed to a furnace bed.

There is a refractory lined ash removal system comprised of an air-locked ash removal auger, an ash lift conveyer and, an enclosed ash dumpster.

There is a refractory lined combustion system comprised of a tuyere plenum, a segmented ceramic combustion hearth contained in a refractory lined hopper, a tuyere manifold, a plurality of tuyeres leading from the tuyere manifold through the tuyere plenum to a burn pile area.

There is a retractable, all-ceramic lance ignition burner projecting from the outside of the tuyere plenum and through the tuyere plenum and into the segmented ceramic combustion hearth and above the burn pile area.

There is a refractory lined upper housing comprising the burn pile area and a feed system for feeding organic materials to the burn pile area. The feed system comprises a hopper for organic material, a conveyor for conveying organic materials to the feed hopper, and a horizontal auger contained in an auger housing for conveying organic material through a ceramic discharge elbow and into the burn pile area.

The auger housing connects the hopper and the discharge ceramic elbow, and the auger housing has a control valve associated with it to control air flow through the auger housing.

There is an air cooling system for the ceramic elbow and auger housing, and the air cooling system comprises an electrical fan and an air feed system, the air feed system comprising an air feed duct housed in a refractory lined housing.

The upper housing of the upper segment contains a burn pile height detector.

In addition to that Supra, there is contemplated within the scope of this invention to use a grate over the air-locked ash removal auger. Preferably this grate is a ceramic grate, and most especially, the ceramic grate is an oscillating ceramic grate system.

One of the major features of this invention is the gasifier feed system which is a horizontal auger driven feed system that feeds directly into the bottom without having to auger the feed through significant vertical elevations.

DETAILED DESCRIPTION OF THE INVENTION

Figure 1:
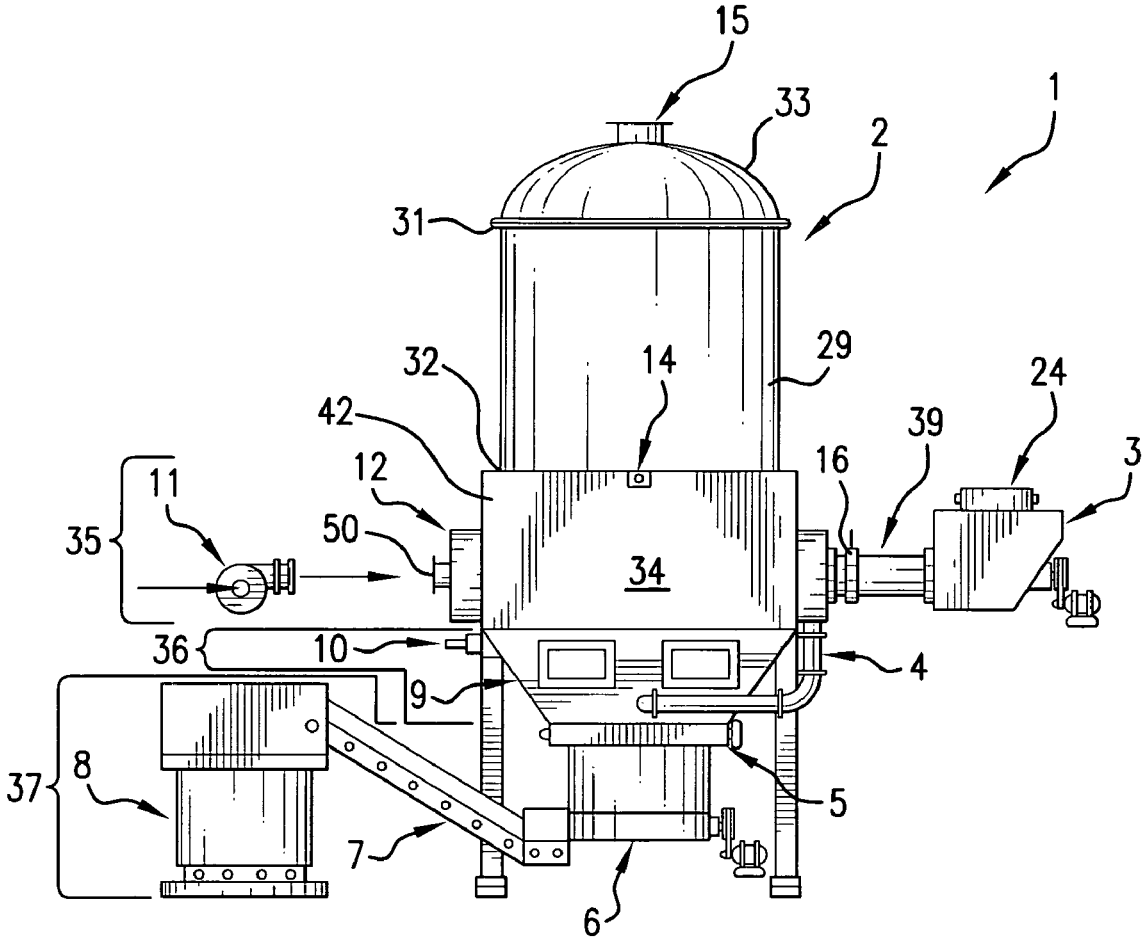
FIG. 1 is a full side view of a gasifier of this invention.

Turning now to FIG. 1 wherein there is shown a full front view of a gasifier system 1 of this invention showing a refractory lined combustion chamber 2 having a cylindrical housing 29 wherein the cylindrical housing has sidewalls 30 (FIG. 2) that are completely lined with a refractory material 27 (FIG. 2), a feed hopper 3, a litter feed conveyor 24, a tuyere air manifold 4, an oscillating ceramic grate 5, an ash auger 6, an ash lift conveyor 7, an enclosed ash dumpster 8, a tuyere plenum 9, a lance ignition burner 10, a combustion air fan 11, a feed tube 12 (FIG. 4), a feed tube housing 13 (FIG. 4), a pile control detector 14, a syngas exit duct 15, and a control valve 16. The cylindrical housing 29 has a top 31 and a bottom 32, the top 31 being surmounted by a monolithic dome 33 having the syngas exit duct 15 mounted thereon (See FIG. 1).

The dome 33 has a hemi-elliptical section comprising a height to diameter ratio of at least 1 to 2 and the dome 33 is also completely lined with a refractory material (not shown).

Figure 2:
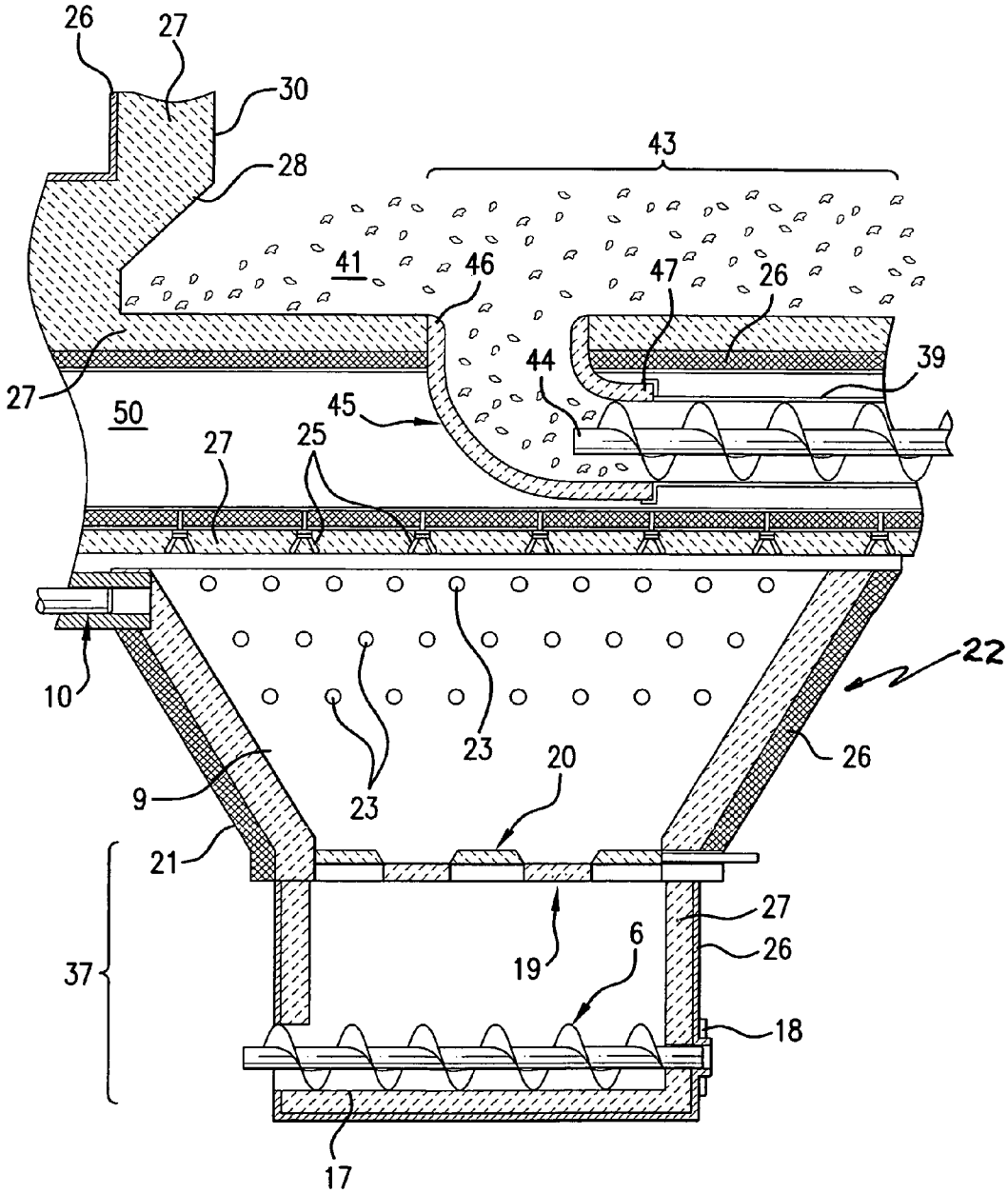
FIG. 2 is a partial cross sectional side view of a portion of the gasifier of FIG. 1, through line 2-2 of FIG. 4.
Figure 4:
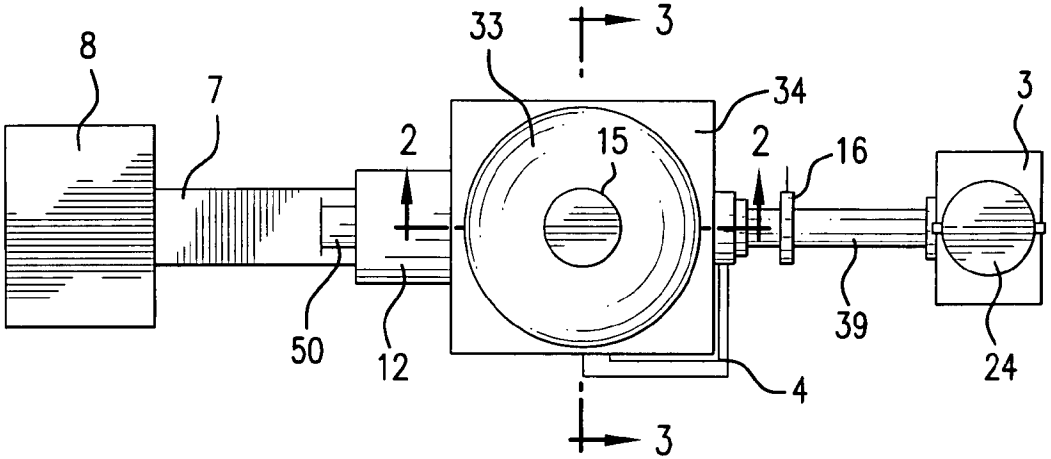
FIG. 4 is a full top view of a gasifier system of this invention.

FIG. 4 is a full top view of the gasifier system 1 of this invention wherein like numbers indicate like components, and FIG. 2 is a full cross sectional view through lines 2-2 of FIG. 4.

The bottom 32 of the sidewall 30 of the cylindrical housing 29 of the combustion chamber 2 is fixed to a furnace bed, generally 34, the furnace bed 34 comprises an upper segment 35, a middle segment 36, and a lower segment 37.

As shown in FIG. 4, the lower segment 37 is a refractory lined ash removal system comprising an air-locked ash removal auger 6 and an ash auger housing 17 for the ash auger 6 and a flange 18 that permits the retention and removal of the auger 6 from the ash auger housing for replacement or repair, an ash lift conveyer 7, and an enclosed ash dumpster 8.

In FIG. 2, there is shown the components of the middle segment 36 which shows a fixed ceramic hearth 19 constructed of replaceable segments and a plurality of oscillating ceramic ash removal plates 20 located above the fixed ceramic hearth 19. Situated above the oscillating ceramic ash removal plates 20 is the tuyere plenum 9 having side wall 21, wherein there is located the retractable ignition burner 10. Multiple tuyeres 23 are inserted through the side walls 21 and lead to a burn pile area, generally 40 in FIGS. 2 and 3 and the tuyeres 23 are fed air or other gas from the tuyere manifold 4 located on the outside of the furnace 34. The tuyeres 23 can be changeable inside diameter tuyeres and can be zoned, manifolded or single plenum, as shown herein, to inject air or flue gas into the tuyere plenum 9 as required by pulsing, steady or varying flow of the burning mass described infra.

The housing for the tuyere plenum 9 the burning chamber 22 is constructed of insulated wear/temperature lining 26, retained with stainless steel alloy "Y" anchors as shown at 25 and is line with insulated fire brick lining 27. It should be noted in FIG. 2 that the combustion chamber 2 is constructed such that there is built into the walls thereof, a stabilizing reflective arch 28. In addition, there is a retractable, all-ceramic lance ignition burner 10 projecting from the outside of the tuyere plenum 9 and through the tuyere plenum 9 and into the segmented ceramic combustion hearth and above the burn pile area 40.

The novelty and essence of this invention is the delivery system for the burnable biomass material 41. The upper segment 35 comprises a refractory lined upper housing 42 containing the burn pile area 40. The upper housing 42 of the upper segment 35 contains a burn pile height detector 14.

The feed system 43, generally, comprises a system for feeding organic materials (biomass, litter, etc.) to the burn pile area 40. The system comprises a hopper 3 for the biomass material 41, a biomass material conveyor 24 for conveying the biomass 41 to the feed hopper 3, an auger system 38 comprising a horizontal auger 44 contained in an auger housing 39.

The auger housing 39 terminates inside of the furnace 34 in a ceramic feed elbow 45 that is directed upwardly from the terminal end of the auger housing 39 and allows the biomass material 41 to overflow and descend to the burn pile area 40. The horizontal feed system 43 is possible because of the ceramic elbow 45. It should be noted that the ceramic elbow 45 is preferred to be wider at the top 46 than at the bottom 47 to enhance the flow of biomass material 41 through the ceramic elbow 45.

Figure 3:
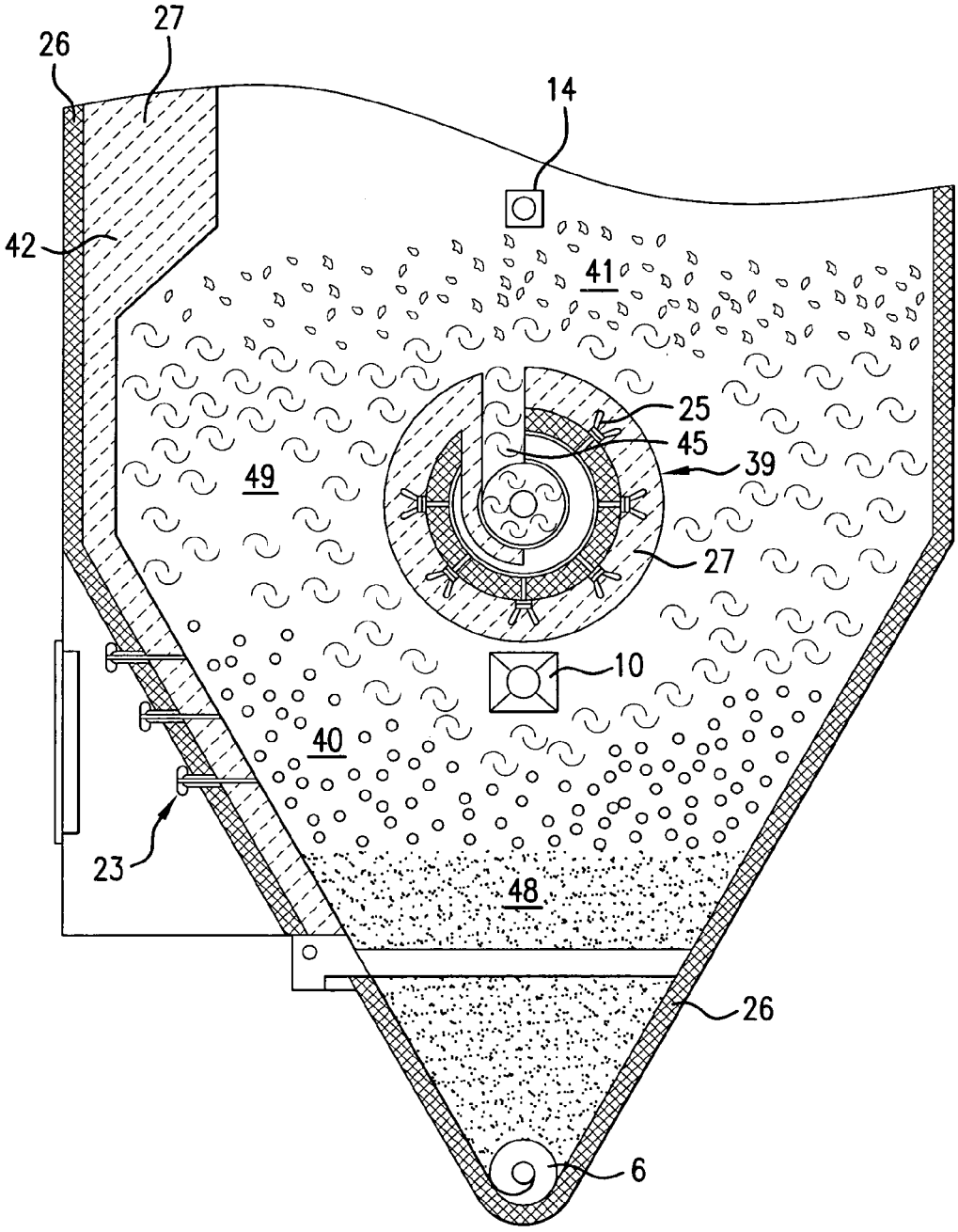
FIG. 3 is a cross sectional view of a portion of the gasifier of FIG. 1, through line 3-3 of FIG. 4.

FIG. 3 also shows the accumulation of ash 48 and the general distillates 49 that are generated by the burning pile of biomass material 41.

As can be observed from FIG. 1, in addition to the tuyeres 23, air is introduced into the furnace 34 through a duct 50 using an auxiliary fan 11 to enhance the burning activity in the furnace 34. This provide for an air cooling system for the ceramic elbow 45 and auger housing 39. This system is comprised of an electrical fan and an air feed system that is integrated and controlled by the gasifier.

What is claimed is:

1. An improved gasifier system for pyrolyzing organic material, said gasifier system comprising:

(A) a gasifier having a cylindrical housing, said cylindrical housing having a sidewall, the sidewall being completely lined with a refractory material, said sidewall having a top and a bottom;

the top of the sidewall being closed and sealed with a monolithic dome, the dome comprising a hemi-elliptical section, the hemi-elliptical section comprising a height to diameter ratio of at least 1 to 2, the dome having a top and being completely lined with a refractory material, said dome having a syngas exit duct centered at the top thereof;

the bottom of the sidewall being fixed to (B) a furnace bed, the furnace bed comprising:

(C) an upper segment, (D) a middle segment and, (E) a lower segment, the lower segment (E) being a refractory lined ash removal system comprising:

(i) an air-locked ash removal auger;

(ii) an ash lift conveyer and, (iii) an enclosed ash dumpster;

the middle segment (D) being a refractory lined combustion system comprising:

(i) a tuyere plenum;

(ii) a segmented ceramic combustion hearth contained in a refractory lined hopper;

(iii) a tuyere manifold;

(iv) a plurality of tuyeres leading from the tuyere manifold through the tuyere plenum to a burn pile area;

(v) a retractable, all-ceramic lance ignition burner projecting from the outside of the tuyere plenum and through the tuyere plenum and into the segmented ceramic combustion hearth;

the upper segment (C) being a refractory lined upper housing comprising the top of the burn pile and said upper housing of the upper segment containing a burn pile height detector, the improvement comprising:

(F) a feed system for feeding organic materials to the burn pile area, the feed system comprising:

(a) a hopper for organic material;

(b) a conveyor for conveying organic materials from the feed hopper;

(c) a horizontal auger contained in an auger housing for conveying organic material through a ceramic discharge elbow to overflow and descend into the burn pile area, such that the discharge elbow is positioned above the refractory lined combustion system containing the burn pile, said auger housing connecting the hopper and the discharge ceramic elbow, said auger housing having a control valve associated therewith to control air flow through the auger housing;

(d) an air cooling system for the ceramic elbow and auger housing, said air cooling system comprising an electrical fan and an air feed system, said air feed system comprising an air feed duct housed in a refractory lined housing.

2. A gasifier as claimed in claim 1 wherein the segmented ceramic combustion hearth hopper has a rectangular configuration.

3. A gasifier as claimed in claim 1 wherein the segmented ceramic combustion hearth hopper has a circular configuration.

4. A gasifier as claimed in claim 1 wherein the refractory lined ash removal system has in addition, a grate located over the air-locked ash removal auger.

5. A gasifier as claimed in claim 4 wherein the grate is a ceramic grate.

6. A gasifier as claimed in claim 5 wherein the ceramic grate is an oscillating ceramic grate system.

7. A gasifier feed system comprising:

(F) a feed system for feeding organic materials to a burn pile area, the feed system comprising:

(a) a hopper for organic material;

(b) a conveyor for conveying organic materials from the feed hopper;

(c) a horizontal auger contained in an auger housing for conveying organic material through a ceramic discharge elbow to overflow and descend into the burn pile, such that the discharge elbow is positioned above a refractory lined combustion system containing the burn pile, said auger housing connecting the hopper and the discharge ceramic elbow, said auger housing having a control valve associated therewith to control air flow through the auger housing.

8. The gasifier feed system as claimed in claim 7 wherein there is in addition, an air cooling system for the ceramic elbow and auger housing, said air cooling system comprising an electrical fan and an air feed system, said air feed system comprising an air feed duct housed in a refractory lined housing.

* * * * *